US009368069B2

(12) United States Patent
Woo et al.

(10) Patent No.: US 9,368,069 B2
(45) Date of Patent: Jun. 14, 2016

(54) STAGE CIRCUIT AND ORGANIC LIGHT EMITTING DISPLAY DEVICE USING THE SAME

(71) Applicant: SAMSUNG DISPLAY CO., LTD., Yongin, Gyeonggi-Do (KR)

(72) Inventors: Min-Kyu Woo, Yongin (KR); Seung-Kyu Lee, Yongin (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 7 days.

(21) Appl. No.: 14/339,835

(22) Filed: Jul. 24, 2014

(65) Prior Publication Data

US 2015/0035733 A1 Feb. 5, 2015

(30) Foreign Application Priority Data

Aug. 5, 2013 (KR) ..... 10-2013-0092470

(51) Int. Cl.
*G09G 3/32* (2006.01)

(52) U.S. Cl.
CPC ..... *G09G 3/3266* (2013.01); *G09G 2310/0286* (2013.01)

(58) Field of Classification Search
CPC ..... G09G 2310/0286; G09G 2310/0264; G09G 3/3266; G09G 3/3674–3/3681
See application file for complete search history.

(56) References Cited

U.S. PATENT DOCUMENTS 7,256,775 B2 * 8/2007 Eom ..... G09G 3/3233 315/169.3
7,545,351 B2 * 6/2009 Shin ..... G09G 3/325 345/76
7,652,645 B2 * 1/2010 Park ..... G09G 3/3266 345/100
7,710,368 B2 * 5/2010 Chung ..... G09G 3/3233 345/76
8,035,581 B2 * 10/2011 Choi ..... G09G 3/3266 345/76
8,125,422 B2 * 2/2012 Choi ..... G09G 3/3266 345/100

(Continued)

FOREIGN PATENT DOCUMENTS

KR 10-2010-0087871 8/2010
KR 10-2012-0028006 3/2012

(Continued)

*Primary Examiner* — Patrick F Marinelli
(74) *Attorney, Agent, or Firm* — Lee & Morse, P.C.

(57) ABSTRACT

A driver includes a first circuit to output a scan signal and a second circuit to output an emission control signal. The first circuit outputs the scan signal based on a first set of clock signals, and the second circuit outputs the emission control signal based on a second set of clock signals. The first set of clock signals and the second set of clock signals have at least one same clock signal and at least one different clock signal. The second circuit receives the scan signal and outputs the emission control signal based on the scan signal. The first circuit may be a scan driver and the second circuit may be an emission control driver of a display device.

20 Claims, 5 Drawing Sheets

(56) References Cited

U.S. PATENT DOCUMENTS 8,582,715 B2 * 11/2013 Chung ..... H03K 17/687 327/108
8,599,117 B2 * 12/2013 Jang ..... G09G 3/3266 345/77
8,669,969 B2 * 3/2014 Chung ..... G09G 3/3266 315/169.2
8,674,905 B2 * 3/2014 Eom ..... G09G 3/3233 345/76
9,013,456 B2 * 4/2015 Chung ..... G09G 3/3266 345/204
9,019,191 B2 * 4/2015 Woo ..... H05B 37/02 345/100
9,129,562 B2 * 9/2015 Jang ..... G09G 3/3266
2003/0128180 A1 * 7/2003 Kim ..... G09G 3/3677 345/100
2005/0264493 A1 * 12/2005 Shin ..... G09G 3/325 345/76
2005/0285827 A1 * 12/2005 Eom ..... G09G 3/3233 345/76
2006/0022912 A1 * 2/2006 Park ..... G09G 3/3266 345/76
2006/0103323 A1 * 5/2006 Eom ..... G09G 3/3233 315/169.3
2006/0156121 A1 * 7/2006 Chung ..... G09G 3/3233 714/726
2006/0158394 A1 * 7/2006 Choi ..... G09G 3/3266 345/76
2006/0248421 A1 * 11/2006 Choi ..... G09G 3/3266 714/731
2007/0124633 A1 * 5/2007 Kim ..... G09G 3/2003 714/726
2007/0240024 A1 * 10/2007 Shin ..... G09G 3/325 714/726
2008/0062071 A1 * 3/2008 Jeong ..... G11C 19/184 345/46
2008/0062097 A1 * 3/2008 Jeong ..... G09G 3/3266 345/84
2008/0246698 A1 * 10/2008 Eom ..... G09G 3/3266 345/76
2010/0039423 A1 * 2/2010 Jeong ..... G09G 3/3266 345/213
2010/0188316 A1 * 7/2010 Jang ..... G09G 3/3266 345/76
2010/0188381 A1 * 7/2010 Jang ..... G09G 3/3266 345/211
2010/0283776 A1 * 11/2010 Park ..... G09G 3/3233 345/211
2012/0062525 A1 * 3/2012 Kim ..... G09G 3/3233 345/204
2012/0075259 A1 * 3/2012 Chung ..... G09G 3/3266 345/204
2012/0081409 A1 * 4/2012 Chung ..... G09G 3/3266 345/690
2012/0176417 A1 * 7/2012 Jang ..... G09G 3/3266 345/690
2012/0327131 A1 * 12/2012 Jang ..... G09G 3/3266 345/690
2013/0328495 A1 * 12/2013 Woo ..... H05B 37/02 315/224
2013/0342584 A1 * 12/2013 Song ..... G09G 3/3266 345/690
2014/0055444 A1 * 2/2014 Jang ..... G09G 3/3291 345/213
2014/0071114 A1 * 3/2014 Kim ..... G11C 19/28 345/212
2014/0078029 A1 * 3/2014 Jang ..... G09G 3/32 345/82
2014/0368414 A1 * 12/2014 Kim ..... G09G 3/3266 345/77
2014/0375616 A1 * 12/2014 Kim ..... G09G 3/3266 345/211
2015/0015554 A1 * 1/2015 Kim ..... G09G 3/3208 345/208
2015/0022428 A1 * 1/2015 Liu ..... G09G 3/3225 345/76
2015/0035733 A1 * 2/2015 Woo ..... G09G 3/3258 345/76
2015/0061982 A1 * 3/2015 Woo ..... G09G 3/3266 345/82
2015/0138180 A1 * 5/2015 Park ..... G09G 3/3233 345/212
2015/0170568 A1 * 6/2015 Lee ..... G11C 19/287 345/690
2015/0294619 A1 * 10/2015 Lee ..... G09G 3/3266 345/77

FOREIGN PATENT DOCUMENTS

KR 10-2013-0000020 1/2013
KR 10-2013-0143318 12/2013
KR 10-2014-0038148 3/2014

* cited by examiner

STAGE CIRCUIT AND ORGANIC LIGHT EMITTING DISPLAY DEVICE USING THE SAME

CROSS-REFERENCE TO RELATED APPLICATION

Korean Patent Application No. 10-2013-0092470, filed on Aug. 5, 2013, and entitled, "Stage Circuit and Organic Light Emitting Display Device Using The Same," is incorporated by reference herein in its entirety.

BACKGROUND

1. Field

One or more embodiments described herein relate to a display device.

2. Description of the Related Art

A variety of flat panel display devices have been developed. Examples include a liquid crystal display (LCD) device, an organic light emitting display (OLED) device, and a plasma display panel (PDP) are increasingly used. Among these, the OLED device displays images using organic light emitting diodes that emit light through recombination of electrons and holes. The OLED device has also show to have a fast response speed and may be driven with low power consumption.

SUMMARY

In accordance with one embodiment, a stage circuit includes a first supply unit configured to supply a scan signal to a first output terminal, based on voltages received by a first input terminal, a second input terminal, and a fourth input terminal; and a second supply unit configured to supply an emission control signal to a second output terminal, based on voltages received by the first input terminal, the second input terminal, the first output terminal, and a third input terminal, wherein the second supply unit includes: a first transistor coupled between the first output terminal and a third node, the first transistor having a gate electrode coupled to the second input terminal; a second transistor coupled between the third input terminal and a fourth node, the second transistor having a gate electrode coupled to the third node; a third transistor coupled between the third input terminal and the second output terminal, the third transistor having a gate electrode coupled to the third node; and a fourth transistor coupled between the second output terminal and a second power source set to a gate-on voltage, the fourth transistor having a gate electrode coupled to the fourth node.

The second supply unit may include a first capacitor coupled between the fourth node and first input terminal; and a second capacitor coupled between the third node and second output terminal.

The first supply unit may include an output unit configured to supply a first power source set to a gate-off voltage or the voltage of the second input terminal to the first output terminal, corresponding to voltages applied to the first and second nodes; a first driver configured to control the voltage of the second node; and a second driver configured to control the voltage of the first node.

The first driver may include a fifth transistor coupled between the fourth input terminal and second node, the fifth transistor having a gate electrode coupled to the first input terminal; and sixth and seventh transistors coupled in series between the second node and first power source, wherein a gate electrode of the sixth transistor is coupled to the second input terminal and wherein a gate electrode of the seventh transistor is coupled to the first node.

The output unit may include an eighth transistor coupled between the first power source and the first output terminal, the eighth transistor having a gate electrode coupled to the first node; a ninth transistor coupled between the first output terminal and second input terminal, the ninth transistor having a gate electrode coupled to the second node; a third capacitor coupled between the second node and first output terminal; and a fourth capacitor coupled between the first node and first power source.

The second driver may include a tenth transistor coupled between the first node and the first input terminal, the tenth transistor having a gate electrode coupled to the second node; and an eleventh transistor coupled between the first node and the second power source, the eleventh transistor having a gate electrode coupled to the first input terminal.

The second driver may include a tenth transistor coupled between the first node and the first input terminal, the tenth transistor having a gate electrode coupled to the second node; and a eleventh transistor diode-coupled between the first node and the first input terminal. The eleventh transistor may be coupled to allow current to flow from the first node to the first input terminal.

In accordance with another embodiment, an organic light emitting display device includes pixels positioned in an area including scan lines, data lines and emission control lines; a data driver configured to supply data signals to the data lines; and a scan/emission driver configured to supply scan signals to the scan lines and to supply emission control signals to the emission control lines, the scan/emission driver having a plurality of stages, each of the stages including: a first supply unit configured to supply the scan signal to a first output terminal, based on voltages received by a first input terminal, a second input terminal, and a fourth input terminal; and a second supply unit configured to supply the emission control signal to a second output terminal, based on voltages received by the first input terminal, the second input terminal, the first output terminal, and a third input terminal The second supply unit includes an first transistor coupled between the first output terminal and a third node, the first transistor having a gate electrode coupled to the second input terminal; a second transistor coupled between the third input terminal and a fourth node, the second transistor having a gate electrode coupled to the third node; a third transistor coupled between the third input terminal and second output terminal, the third transistor having a gate electrode coupled to the third node; and an fourth transistor coupled between the second output terminal and a second power source set to a gate-on voltage, the fourth transistor having a gate electrode coupled to the fourth node.

A clock signal supplied to the second input terminal may be used as the scan signal, and a clock signal supplied to the third input terminal may be used as the emission control signal. The fourth input terminal may receive a scan signal of a previous stage or a start signal. The start signal may be supplied to be synchronized with a clock signal supplied to the first input terminal.

The first, second, and third input terminals of an odd-numbered stage may receive a first clock signal, a second clock signal, and a third clock signal, respectively, and the first, second, and third input terminals of an even-numbered stage may receive the second clock signal, the first clock signal, and a fourth clock signal, respectively.

The first and second clock signals may have substantially a same period, and the voltages of low signals of the first and second clock signals may not overlap each other. The third and fourth clock signals may have substantially a same period, and the voltages of high signals of the third and fourth clock signals may not overlap each other. The high signal of the third clock signal may overlap the low signal of the second clock signal during at least one period, and the high signal of the fourth clock signal may overlap the low signal of the first clock signal during at least one period.

The second supply unit may include a first capacitor coupled between the fourth node and first input terminal; and a second capacitor coupled between the third node and second output terminal. The first supply unit may include an output unit configured to supply a first power source set to a gate-off voltage or the voltage of the second input terminal to the first output terminal, corresponding to voltages applied to the first and second nodes; a first driver configured to control the voltage of the second node; and a second driver configured to control the voltage of the first node.

The first driver may include a fifth transistor coupled between the fourth input terminal and the second node, the fifth transistor having a gate electrode coupled to the first input terminal; and sixth and seventh transistors coupled in series between the second node and first power source, wherein a gate electrode of the sixth transistor is coupled to the second input terminal, and a gate electrode of the seventh transistor is coupled to the first node.

The output unit may include an eighth transistor coupled between the first power source and the first output terminal, the eighth transistor having a gate electrode coupled to the first node; a ninth transistor coupled between the first output terminal and second input terminal, the ninth transistor having a gate electrode coupled to the second node; a third capacitor coupled between the second node and the first output terminal; and a fourth capacitor coupled between the first node and first power source.

The second driver may include a tenth transistor coupled between the first node and the first input terminal, the tenth transistor having a gate electrode coupled to the second node; and a eleventh transistor coupled between the first node and second power source, the eleventh transistor having a gate electrode coupled to the first input terminal.

The second driver may include a tenth transistor coupled between the first node and the first input terminal, the tenth transistor having a gate electrode coupled to the second node; and an eleventh transistor diode-coupled between the first node and first input terminal. The eleventh transistor may be coupled to allow current to flow from the first node to the first input terminal.

In accordance with another embodiment, a driver includes a first circuit to output a scan signal; and a second circuit to output an emission control signal, wherein the first circuit outputs the scan signal based on a first set of clock signals and the second circuit outputs the emission control signal based on a second set of clock signals, the first set of clock signals and the second set of clock signals having at least one same clock signal and at least one different clock signal, and wherein the second circuit receives the scan signal and outputs the emission control signal based on the scan signal.

The first set of clock signals may include at least a first clock signal and a second clock signal; and the second set of clock signals may include the first clock signal, the second clock signal, and a third clock signal. The first and second clock signals may not overlap. The second and third clock signal may at least partially overlap. The scan signal and emission signal may at least partially overlap. A leading edge of the scan signal may precede a leading edge of the emission control signal. The first set of clock signals and the second set of clock signals may have substantially a same period.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
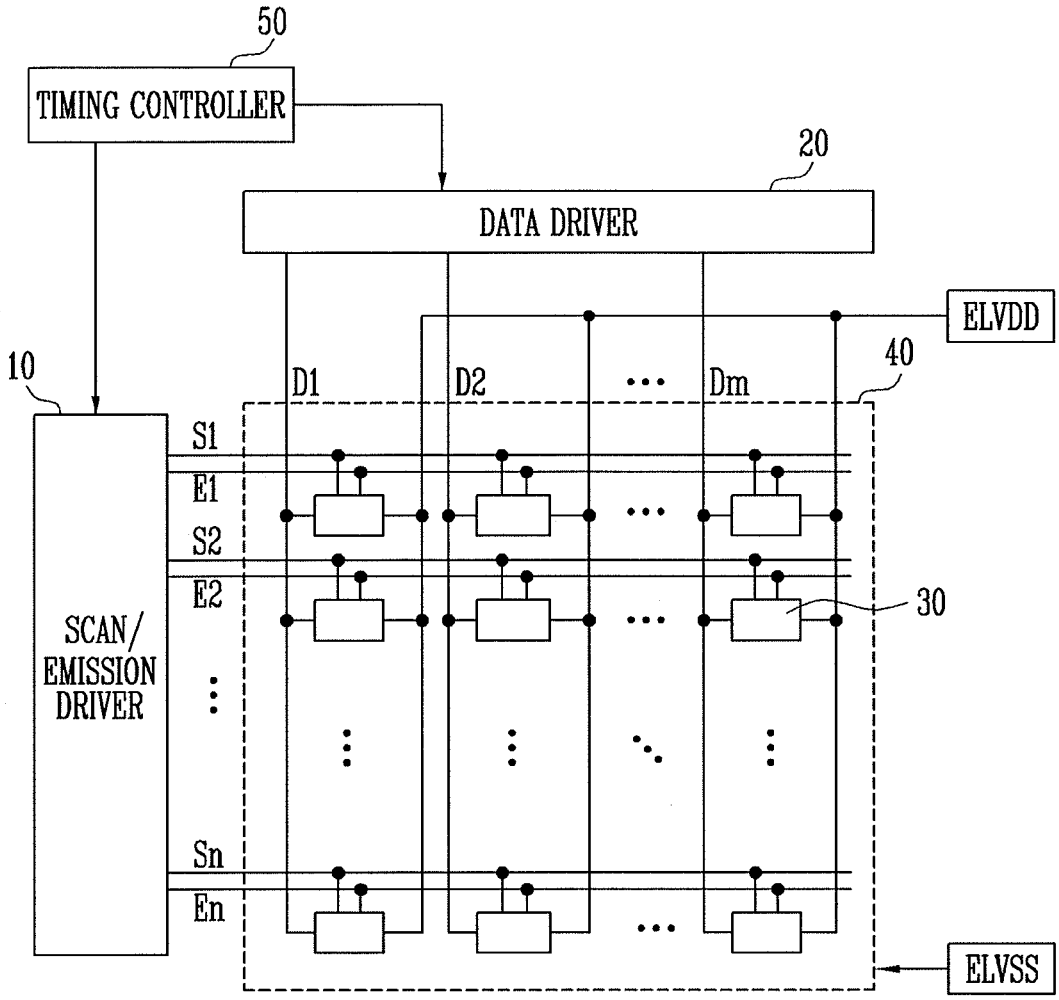
FIG. 1 illustrates an embodiment of an organic light emitting display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawing figures, the dimensions of layers and regions may be exaggerated for clarity of illustration.

FIG. 1 illustrates an embodiment of an organic light emitting display device which includes a pixel unit 40 configured to include pixels 30 positioned in an area defined by scan lines S1 to Sn, emission control lines E1 to En, and data lines D1 to Dm. The device also includes a scan/emission driver 10 configured to drive the scan lines S1 to Sn and emission control lines E1 to En, a data driver 20 configured to drive the data lines D1 to Dm, and a timing controller 50 configured to control the scan/emission driver 10 and the data driver 20.

The scan/emission driver 10 drives scan lines S1 to Sn and emission control lines E1 to En. In one embodiment, the scan/emission driver 10 progressively supplies scan signals to the scan lines S1 to Sn, and progressively supplies emission control signals to the emission control lines E1 to En. The scan/emission driver 10 may supply the scan signals and emission control signals in various forms based on the structure of the pixels 30. For example, the scan/emission driver 10 may supply an emission control signal to an i-th (i is a natural number) emission control line E1 to overlap the scan signal supplied to an i-th scan line Si during a partial period. The scan/emission driver 10 includes a plurality of stages, with each stage coupled to a scan line and an emission control line.

The scan signal is set to a voltage (e.g., a low voltage) at which transistors in pixels 30 can be turned on. The emission control signal is set to a voltage (e.g., a high voltage) at which the transistors in pixels 30 can be turned off.

The data driver 20 supplies data signals to data lines D1 to Dm, in synchronization with the scan signals. The data signals are then supplied to pixels 30 selected by the scan signals. Accordingly, the selected pixels 30 store a voltage corresponding to the data signal.

The timing controller 50 supplies a control signal for controlling scan/emission driver 10 and data driver 20. The timing controller 50 supplies, to the data driver 20, data supplied from a source external to the organic light emitting display device.

Each pixel 30 stores a voltage corresponding to the data signal. Each pixel also supplies, to an organic light emitting diode, current corresponding to the stored voltage, to thereby generate light with a predetermined luminance. In one embodiment, pixels 30 may be configured to include various types of circuits for receiving the scan signals and emission control signals.

Figure 2:
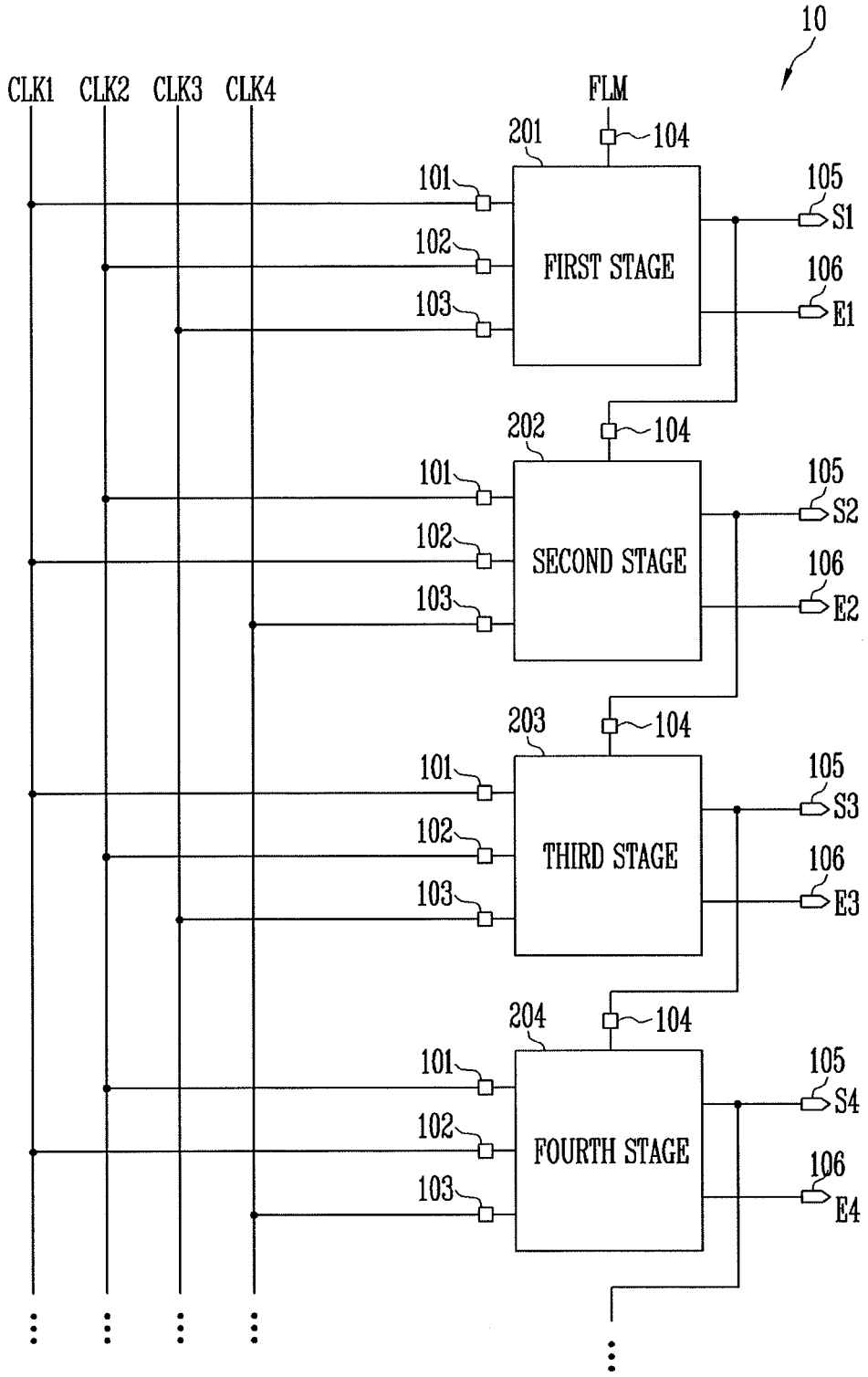
FIG. 2 illustrates an embodiment of stages of a scan/emission driver in FIG. 1.

FIG. 2 illustrates an embodiment of stages of the scan/emission driver 10 in FIG. 1. For convenience of illustration, four stages will be shown in FIG. 2. However, the scan/emission driver may have a different number of stages in other embodiments.

Referring to FIG. 2, the scan/emission driver 10 includes a plurality of stages 201 to 204, each coupled to one scan line and one emission control line. The stages 201 to 204 may be configured to be the same circuit in terms of structure. The stages 201 to 204 progressively supply scan signals to the scan lines S1 to Sn, and progressively supply emission control signals to the emission control lines E1 to En.

Each stage 201 to 204 is driven by three clock signals CLK1, CLK2 and CLK3, or CLK1, CLK2 and CLK4. Each stage 201 to 204 also includes a first input terminal 101, a second input terminal 102, a third input terminal 103, a fourth input terminal 104, a first output terminal 105, and a second output terminal 106.

The first input terminal 101 in an odd-numbered (or even-numbered) stage receives a first clock signal CLK1, and the second input terminal in the odd-numbered (or even-numbered) stage receives a second clock signal CLK2. The first input terminal 101 in an even-numbered (or odd-numbered) stage receives the second clock signal CLK2, and the second input terminal 102 in the even-numbered (or odd-numbered) stage receives the first clock signal CLK1.

The first and second clock signals CLK1 and CLK2 may have the same period, and phases of the first and second clock signals CLK1 and CLK2 do not overlap. For example, the first and second clock signals CLK1 and CLK2 may have a period of two horizontal periods 2H, where a low signal (low voltage) is supplied during different horizontal periods. The first and second clock signals CLK1 and CLK2 are signals used as scan signals. In this case, the low signal is repeated every predetermined period.

The third input terminal 103 in the odd-numbered (or even-numbered) stage receives a third clock signal CLK3. The third input terminal 103 in the even-numbered (or odd-numbered) stage receives a fourth clock signal CLK4. The third and fourth clock signals CLK3 and CLK4 may have the same period, and phases of the third and fourth clock signals CLK3 and CLK4 do not overlap. For example, the third and fourth clock signals CLK3 and CLK4 may have a period of two horizontal periods 2H, with a high signal (high voltage) is supplied during different horizontal periods. The third and fourth clock signals CLK3 and CLK4 are signals used as emission control signals. In this case, the high voltage is repeated every predetermined period.

In the present embodiment, the width of the scan signal may be variously set while controlling the width of the low signal of the first and second clock signals CLK1 and CLK2. Similarly, in the present embodiment, the width of the emission control signal may be variously set while controlling the width of the high signal of the third and fourth clock signals CLK3 and CLK4. For example, the low signal of the first clock signal CLK1 and the high signal of the fourth clock signal CLK4 may overlap during a partial period. Also, the low signal of the second clock signal CLK2 and the high signal of the third clock signal CLK3 may overlap during a partial period.

The fourth input terminal 104 in each stage 201 to 204 receives a sampling signal, which corresponds to the scan signal of a previous stage. The fourth input terminal 104 in the first stage 201 receives a start signal FLM. The first output terminal 105 of each stage 201 to 204 receives a scan signal and supplies the scan signal to a scan line S. The second output terminal 106 of each stage 201 to 204 receives an emission control signal and supplies the emission control signal to an emission control line E.

Figure 3:
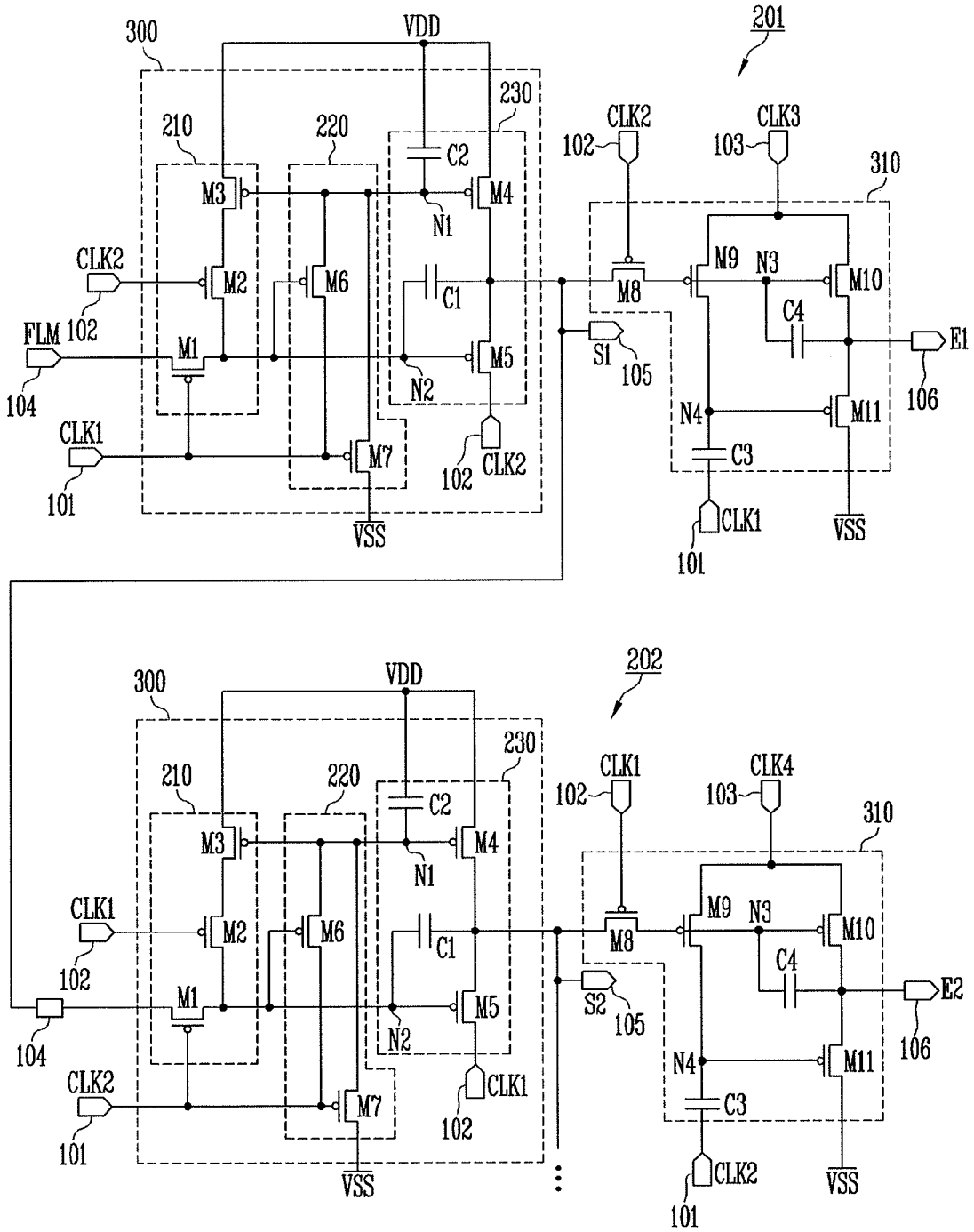
FIG. 3 illustrates an embodiment of a stage in FIG. 2.

FIG. 3 an embodiment of stages shown in FIG. 2. For convenience of illustration, the first and second stages 201 and 202 will be shown in FIG. 3. Referring to FIG. 3, stage 201 includes a first supply unit 300 configured to supply a scan signal and a second supply unit 310 configured to supply an emission control signal.

The first supply unit 300 outputs a scan signal to a scan line S1, corresponding to voltages of the first, second, and fourth input terminals 101, 102 and 104. To this end, the first supply unit 300 includes a first driver 210, a second driver 220, and an output unit 230. The output unit 230 controls a voltage supplied to the first output terminal 105 and second supply unit 310, corresponding to a voltage applied to first and second nodes N1 and N2. To this end, the output unit 230 includes a fourth transistor M4, a fifth transistor M5, a first capacitor C1, and a second capacitor C2.

The fourth transistor M4 is coupled between a first power source VDD and first output terminal 105. A gate electrode of the fourth transistor M4 is coupled to the first node N1. The fourth transistor M4 controls the coupling between the first power source VDD and first output terminal 105, based on the voltage applied to the first node N1. The first power source VDD is set to a gate-off voltage, e.g., a high-level voltage.

The fifth transistor M5 is coupled between first output terminal 105 and second input terminal 102. A gate electrode of the fifth transistor M5 is coupled to the second node N2. The fifth transistor M5 controls the coupling between the first output terminal 105 and second input terminal 102, based on the voltage of the second node N2.

The first capacitor C1 is coupled between the second node N2 and first output terminal 105. The first capacitor C1 charges a voltage corresponding to a turn-on state and a turn-off state of the fifth transistor M5.

The second capacitor C2 is coupled between the first node N1 and first power source VDD. The second capacitor C2 charges based on the voltage applied to the first node N1.

The first driver 210 controls the voltage of the second node N2, based on signals supplied to first input terminal 101, second input terminal 102, and fourth input terminal 104. To this end, the first driver 210 includes first to third transistors M1 to M3.

The first transistor M1 is coupled between the fourth input terminal 104 and the second node N2. A gate electrode of the first transistor M1 is coupled to the first input terminal 101. The first transistor M1 controls the coupling between the fourth input terminal 104 and second node N2, based on the voltage supplied to the first input terminal 101.

The second and third transistors M2 and M3 are coupled in series between the second node N2 and first power source VDD. The second transistor M2 is coupled between the third transistor M3 and second node N2. A gate electrode of the second transistor M2 is coupled to the second input terminal 102. The second transistor M2 controls the coupling between the third transistor M3 and second node N2, based on the voltage supplied to the second input terminal 102.

The third transistor M3 is coupled between the second transistor M2 and first power source VDD. A gate electrode of the third transistor M3 is coupled to the first node N1. The third transistor M3 controls the coupling between the second transistor M2 and first power source VDD, based on the voltage of the first node N1.

The second driver 220 controls the voltage of the first node N1, based on the voltage of the first input terminal 101 and second node N2. To this end, the second driver 220 includes a sixth transistor M6 and a seventh transistor M7.

The sixth transistor M6 is coupled between the first node N1 and first input terminal 101. A gate electrode of the sixth transistor M6 is coupled to the second node N2. The sixth transistor M6 controls the coupling between the first node N1 and the first input terminal 101, based on the voltage of the second node N2.

The seventh transistor M7 is coupled between the first node N1 and a second power source VSS. A gate electrode of the seventh transistor M7 is coupled to the first input terminal 101. The seventh transistor M7 controls the coupling between the first node N1 and second power source VSS, based on the voltage of the first input terminal 101. The second power source VSS may be set to a gate-on voltage, e.g., a low-level voltage.

The second supply unit 310 outputs an emission control signal to an emission control line E1, based on voltages of the first input terminal 101, second input terminal 102, third input terminal 103, and first output terminal 105. To this end, the second supply unit 310 includes eighth to eleventh transistors M8 to M11, a third capacitor C3, and a fourth capacitor C4.

The eighth transistor M8 is coupled between the first output terminal 105 and a third node N3. A gate electrode of the eighth transistor M8 is coupled to the second input terminal 102. The eighth transistor M8 controls the coupling between the first output terminal 105 and the third node N3, based on the voltage supplied to the second input terminal 102.

The ninth transistor M9 is coupled between the third input terminal 103 and a fourth node N4. A gate electrode of the ninth transistor M9 is coupled to the third node N3. The ninth transistor M9 controls the coupling between the third input terminal 103 and the fourth node N4, based on the voltage of the third node N3.

The tenth transistor M10 is coupled between the third input terminal 103 and the second output terminal 106. A gate electrode of the tenth transistor M10 is coupled to the third node N3. The tenth transistor M10 controls the coupling between the third input terminal 103 and the second output terminal 106, based on the voltage of the third node N3.

The eleventh transistor M11 is coupled between the second output terminal 106 and the second power source VSS. A gate electrode of the eleventh transistor M11 is coupled to the fourth node N4. The eleventh transistor M11 controls the coupling between the second output terminal 106 and second power source VSS, based on the voltage of the fourth node N4.

The third capacitor C3 is coupled between the fourth node N4 and first input terminal 101. The third capacitor C3 controls the voltage of the fourth node N4, based on a change in the voltage of the first input terminal 101.

The fourth capacitor C4 is coupled between the third node N3 and second output terminal 106. The fourth capacitor C4 controls the voltage of the third node N3, based on corresponding to a change in the voltage of the second output terminal 106.

Figure 4:
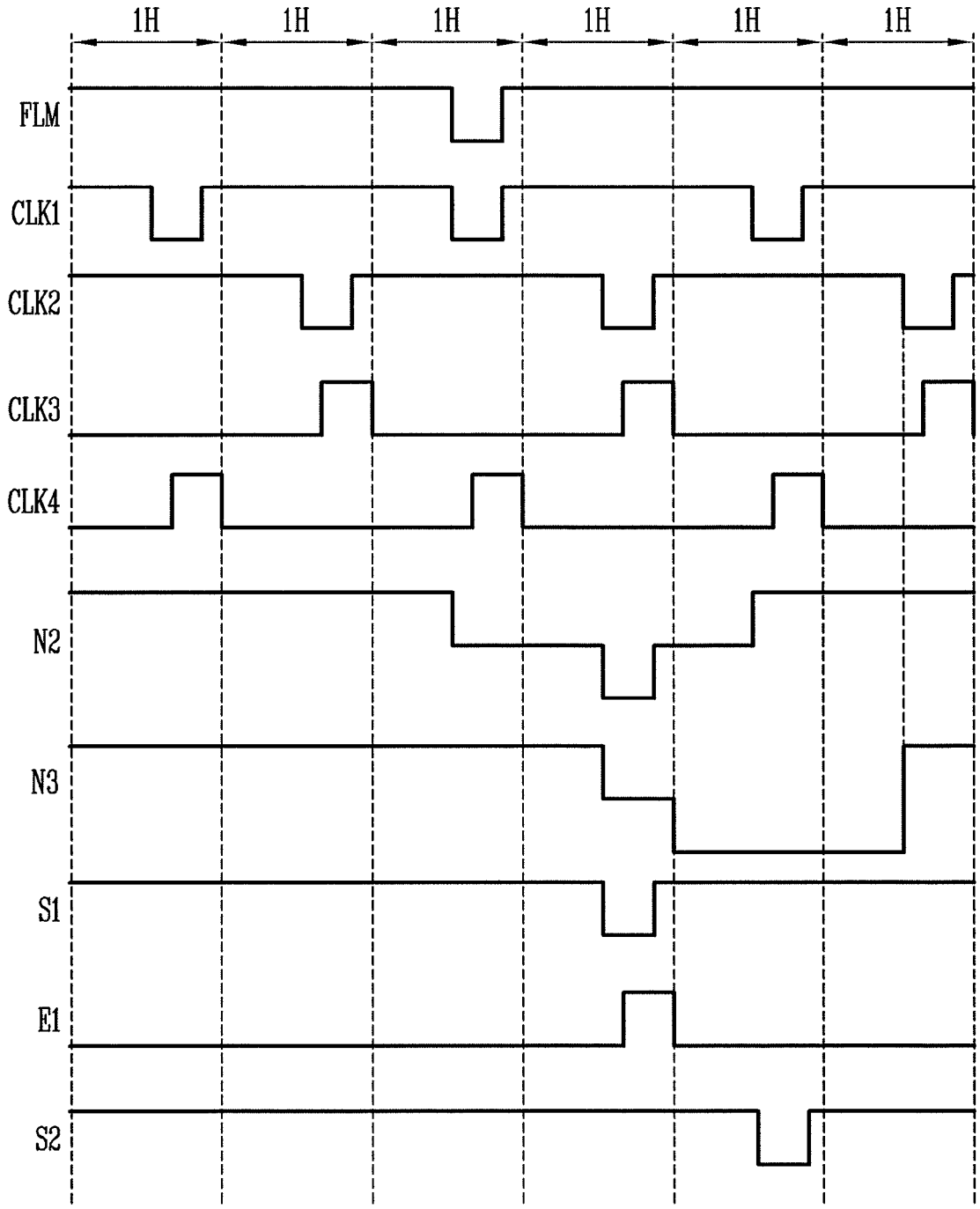
FIG. 4 illustrates an embodiment of a method for driving the stage in FIG. 3.

FIG. 4 is a waveform diagram illustrating one embodiment of a driving method of the stage circuit in FIG. 3. For convenience of illustration, the method will be described relative to first stage 201.

Referring to FIG. 4, the first and second clock signals CLK1 and CLK2 have the same period, and low signals of the first and second clock signals CLK1 and CLK2 are supplied in different horizontal periods. The third and fourth clock signals CLK3 and CLK4 have the same period, and high signals of the third and fourth clock signals CLK3 and CLK4 are supplied in different horizontal periods.

The start signal FLM is supplied to the fourth input terminal 104, in synchronization with the first clock signal CLK1 supplied to the first input terminal 101. In accordance with one embodiment, during the aforementioned periods, supply of the first and second clock signals CLK1 and CLK2 is understood to mean that the low signal (i.e., the low voltage of the first and second clock signals CLK1 and CLK2) is supplied. In addition, supply of the third and fourth clock signals CLK3 and CLK4 is understood to mean that the high signal (i.e., the high voltage of the third and fourth clock signals CLK3 and CLK4) is supplied.

If the first clock signal CLK1 is supplied, the first and seventh transistors M1 and M7 are turned on. If the first transistor M1 is turned on, the fourth input terminal 104 and the second node N2 are electrically coupled to each other. In this case, the second node N2 is set to the low voltage by start signal FLM supplied from the fourth input terminal 104. If the second node N2 is set to the low voltage, the fifth and sixth transistors M5 and M6 are turned on.

If the fifth transistor M5 is turned on, the second input terminal 102 and the first output terminal 105 are electrically coupled to each other. In this case, the second input terminal 102 is set to the high voltage (i.e., the second clock signal CLK2 is not supplied). Accordingly, the high voltage is also output to the first output terminal 105.

If the sixth transistor M6 is turned on, the first input terminal 101 and the first node N1 are electrically coupled to each other. In this case, the first node N1 is set to the low voltage by the first clock signal CLK1 supplied from the first input terminal 101. Additionally, the seventh transistor M7 is turned on corresponding to the first clock signal CLK1, so that the voltage of the second power source VSS is supplied to the first node N1. Here, the voltage of the second power source VSS is set to a voltage equal (or similar) to the first clock signal CLK1. Accordingly, the first node N1 stably maintains the low voltage.

If the low voltage is supplied to the first node N1, the third and fourth transistors M3 and M4 are turned on. If the third transistor M3 is turned on, the first power source VDD and the second transistor M2 are electrically coupled to each other. Here, the second transistor M2 is set to the turn-off state. Hence, the second node N2 stably maintains the low voltage even though the third transistor M3 is turned on. If the fourth transistor M4 is turned on, the voltage of the first power source VDD is supplied to the first output terminal 105. Here, the voltage of the first power source VDD is set to a voltage equal to the high voltage supplied to the second input terminal 102. Accordingly, the first output terminal 105 stably maintains the high voltage.

Subsequently, supply of the start signal FLM and the first clock signal CLK1 is stopped. If supply of the first clock CLK1 is stopped, the first and seventh transistors M1 and M7 are turned off. In this case, the fifth and sixth transistors M5 and M6 maintain the turn-on state, based on the voltage stored in the first capacitor C1.

In a case where the fifth transistor M5 maintains the turn-on state, the electrical coupling between the first output terminal 105 and the second input terminal 102 is maintained. Thus, the output terminal 104 receives the high voltage supplied from the second input terminal 102.

In a case where the sixth transistor M6 maintains the turn-on state, the electrical coupling between the first node N1 and the first input terminal 101 is maintained. In this case, the first input terminal 101 is set to the high voltage, based on supply of the first clock signal CLK1 being stopped. Accordingly, the voltage of the first node N1 is also set to the high voltage. If the high voltage is supplied to the first node N1, the third and fourth transistors M3 and M4 are turned off.

Subsequently, the second clock signal CLK2 is supplied to the second input terminal 102. In this case, the fifth transistor M5 is set to the turn-on state. Hence, the second clock signal CLK2 supplied to the second input terminal 102 is supplied to the first output terminal 105. When the second clock signal CLK2 is supplied to the first output terminal 105, the voltage of the second node N2 drops to a voltage lower than that of the second clock signal CLK2 by coupling of the first capacitor C1. Accordingly, the fifth transistor M5 stably maintains the turn-on state. The second clock signal CLK2 supplied to the first output terminal 105 is output as a scan signal to the scan line S1.

If the second clock signal CLK2 is supplied to the second input terminal 102, the eighth transistor M8 is turned on. If the eighth transistor M8 is turned on, the first output terminal 105 and the third node N3 are electrically coupled to each other. In this case, the third node N3 is set to the low voltage, based on the second clock signal CLK2.

If the third node N3 is set to the low voltage, the ninth and tenth transistors M9 and M10 are turned on. If the ninth transistor M9 is turned on, the third input terminal 103 and the fourth node N4 are electrically coupled to each other. In this case, the third clock signal CLK3 (i.e., the high voltage) is supplied to the third input terminal 103. Thus, the high voltage is supplied to the fourth node N4. Accordingly, the eleventh transistor M11 is set to the turn-off state.

If the tenth transistor M10 is turned on, the second output terminal 106 and the third input terminal 103 are electrically coupled to each other. Thus, the third clock signal CLK3 from the third input terminal 103 is supplied to the second output terminal 106. The third clock signal CLK3 supplied to the second output terminal 106 is output as an emission control signal to the emission control line E1.

After the scan signal and the emission control signal are respectively output to the scan line S1 and the emission control line E1, the first clock signal CLK1 is supplied to the first input terminal 101. If the first clock signal CLK1 is supplied to the first input terminal 101, the first and seventh transistors M1 and M7 are turned on.

If the first transistor M1 is turned on, the fourth input terminal 104 and the second node N2 are electrically coupled to each other. In this case, the start signal FLM is not supplied to the fourth input terminal 104. Accordingly, the fourth input terminal 104 is set to the high voltage. Thus, if the first transistor M1 is turned on, the high voltage is supplied to the second node N2. Accordingly, the fifth and sixth transistors M5 and M6 are turned off.

If the seventh transistor M7 is turned on, the voltage of the second power source VSS is supplied to the first node N1. Accordingly, the third and fourth transistors M3 and M4 are turned on. If the fourth transistor M4 is turned on, the voltage of the first power source VDD is supplied to the first output terminal 105. Subsequently, the fourth and third transistors M4 and M3 maintain the turn-on state, based on the voltage charged in the second capacitor C2. Accordingly, the first output terminal 105 stably receives the voltage of the first power source VDD.

Subsequently, the second clock signal CLK2 is supplied to the second input terminal 102. If the second clock signal CLK2 is supplied to the second input terminal 102, the second and eighth transistors M2 and M8 are turned on. If the second transistor M2 is turned on, the voltage of the first power source VDD is supplied to the second node N2. In this case, the fifth and sixth transistors M5 and M6 stably maintain the turn-off state.

If the eighth transistor M8 is turned on, the voltage of the first power source VDD, supplied to the first output terminal 105, is supplied to the third node N3. If the voltage of the first power source VDD is supplied to the third node N3, the ninth and tenth transistors M9 and M19 are set to the turn-off state. Meanwhile, during the period in which the ninth transistor M9 is turned on, the voltage of the fourth node N4 is set to the low voltage, based on the supply of the third clock signal CLK3 being stopped.

In this case, the eleventh transistor M11 is turned on, so that the voltage of the second power source VSS is output to the second output terminal 106. When the first clock signal CLK1 is supplied to the first input terminal 101, the voltage of the fourth node N4 drops by coupling of the third capacitor C3. Accordingly, the eleventh transistor M11 stably maintains the turn-on state.

Meanwhile, the second stage 202 receives the output signal (i.e., the scan signal) of the second stage 201, in synchronization with the second clock signal CLK2. In this case, the second stage 202 outputs the scan signal and the emission control signal, in synchronization with the first clock signal CLK1. Actually, the stages of the present embodiment progressively supply scan signals to the scan lines S1 to Sn, and progressively supply emission control signals to the emission control lines E1 to En, while repeating the aforementioned procedure.

Figure 5:
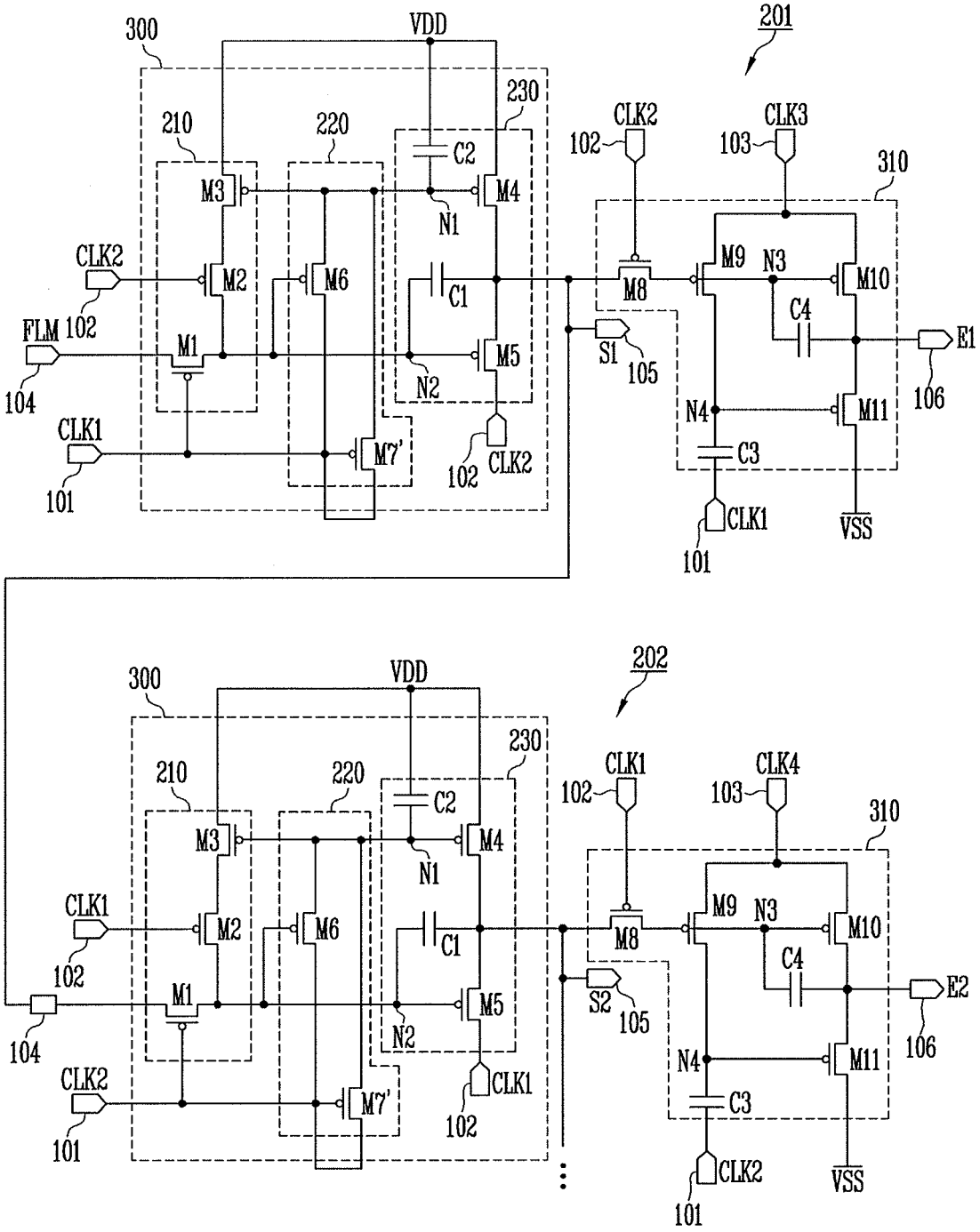
FIG. 5 illustrates another embodiment of a stage in FIG. 2.

FIG. 5 illustrates another embodiment of the stages shown in FIG. 2. Referring to FIG. 5, in this stage, a seventh transistor MT is diode-coupled between the first node N1 and the first input terminal 101. In other words, the seventh transistor MT is diode-coupled so that current can flow from the first node N1 to the first input terminal 101. In a case where the clock signal CLK1 or CLK2 is supplied to the first input terminal 101, the voltage of the first node N1 drops to the low voltage. The operating process of the stage, except the seventh transistor M7', is identical to that of the stage in the embodiment shown in FIG. 3.

In the aforementioned embodiments, the transistors are shown as PMOS transistors. However, in other embodiments, NMOS transistors may be used, or a combination of PMOS and NMOS transistors.

By way of summation and review, an organic light emitting display device includes a data driver configured to supply data signals to data lines, a scan driver configured to progressively supply scan signals to scan lines, an emission control driver configured to progressively supply emission control signals to emission control lines, and a pixel unit configured to include a plurality of pixels coupled to the scan lines and the data lines.

Pixels in the pixel unit are selected when a scan signal is supplied to a scan line, to receive a data signal from a data line. The pixels receiving the data signal generate light with a predetermined luminance based on the data signal, thereby displaying an image. The pixels are set to the non-emission state, based on an emission control signal supplied from an emission control line during a period when the data signal is charged.

Meanwhile, the scan driver includes stages respectively coupled to the scan lines, and the emission control driver includes stages respectively coupled to the emission control lines. Each stage includes a plurality of transistors and a plurality of capacitors.

In a case where the stages are mounted on a panel of the organic light emitting display device, the panel may have a first mounting area and a second mounting area. The first mounting area includes stages of the scan driver. The second mounting area includes stages of the emission control driver. That is, the stages of the scan driver and stages of the emission control driver may be located in separate mounting areas. This may increase the amount of unused space in the device, and may also make it difficult to reduce thickness and area of the panel.

In the stage circuit and organic light emitting display device of the aforementioned embodiments, it is possible to generate a scan signal and an emission control signal using one stage, thereby minimizing a mounting area.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A stage circuit, comprising:

a first supply circuit to supply a scan signal to a first output terminal, based on voltages received by a first input terminal, a second input terminal, and a fourth input terminal; and a second supply circuit to supply an emission control signal to a second output terminal, based on voltages received by the first input terminal, the second input terminal, the first output terminal, and a third input terminal, wherein the second supply circuit includes:

a first transistor coupled between the first output terminal and a third node, the first transistor having a gate electrode coupled to the second input terminal;

a second transistor coupled between the third input terminal and a fourth node, the second transistor having a gate electrode coupled to the third node;

a third transistor coupled between the third input terminal and the second output terminal, the third transistor having a gate electrode coupled to the third node; and a fourth transistor coupled between the second output terminal and a second power source set to a gate-on voltage, the fourth transistor having a gate electrode coupled to the fourth node.

2. The stage circuit as claimed in claim 1, wherein the second supply circuit further includes:

a first capacitor coupled between the fourth node and first input terminal; and a second capacitor coupled between the third node and second output terminal.

3. The stage circuit as claimed in claim 1, wherein the first supply circuit includes:

an output circuit to supply a first power source set to a gate-off voltage or the voltage of the second input terminal to the first output terminal, corresponding to voltages applied to a first node and a second node;

a first driver to control the voltage of the second node; and a second driver to control the voltage of the first node.

4. The stage circuit as claimed in claim 3, wherein the first driver includes:

a fifth transistor coupled between the fourth input terminal and second node, the fifth transistor having a gate electrode coupled to the first input terminal; and sixth and seventh transistors coupled in series between the second node and first power source, wherein a gate electrode of the sixth transistor is coupled to the second input terminal and wherein a gate electrode of the seventh transistor is coupled to the first node.

5. The stage circuit as claimed in claim 3, wherein the output circuit includes:

an eighth transistor coupled between the first power source and the first output terminal, the eighth transistor having a gate electrode coupled to the first node;

a ninth transistor coupled between the first output terminal and second input terminal, the ninth transistor having a gate electrode coupled to the second node;

a third capacitor coupled between the second node and first output terminal; and a fourth capacitor coupled between the first node and first power source.

6. The stage circuit as claimed in claim 3, wherein the second driver includes:

a tenth transistor coupled between the first node and the first input terminal, the tenth transistor having a gate electrode coupled to the second node; and an eleventh transistor coupled between the first node and the second power source, the eleventh transistor having a gate electrode coupled to the first input terminal.

7. The stage circuit as claimed in claim 3, wherein the second driver includes:

a tenth transistor coupled between the first node and the first input terminal, the tenth transistor having a gate electrode coupled to the second node; and a eleventh transistor diode-coupled between the first node and the first input terminal.

8. The stage circuit as claimed in claim 7, wherein the eleventh transistor is coupled to allow current to flow from the first node to the first input terminal.

9. An organic light emitting display device, comprising:

pixels positioned in an area including scan lines, data lines and emission control lines;

a data driver to supply data signals to the data lines; and a scan/emission driver to supply scan signals to the scan lines and to supply emission control signals to the emission control lines, the scan/emission driver having a plurality of stages, each of the stages including:

a first supply circuit to supply the scan signal to a first output terminal, based on voltages received by a first input terminal, a second input terminal, and a fourth input terminal; and a second supply circuit to supply the emission control signal to a second output terminal, based on voltages received by the first input terminal, the second input terminal, the first output terminal, and a third input terminal, and wherein the second supply circuit includes:

an first transistor coupled between the first output terminal and a third node, the first transistor having a gate electrode coupled to the second input terminal;

a second transistor coupled between the third input terminal and a fourth node, the second transistor having a gate electrode coupled to the third node;

a third transistor coupled between the third input terminal and second output terminal, the third transistor having a gate electrode coupled to the third node; and an fourth transistor coupled between the second output terminal and a second power source set to a gate-on voltage, the fourth transistor having a gate electrode coupled to the fourth node.

10. The device as claimed in claim 9, wherein:

a clock signal supplied to the second input terminal is used as the scan signal, and a clock signal supplied to the third input terminal is used as the emission control signal.

11. The device as claimed in claim 9, wherein the fourth input terminal receives a scan signal of a previous stage or a start signal.

12. The device as claimed in claim 11, wherein the start signal is supplied to be synchronized with a clock signal supplied to the first input terminal.

13. The device as claimed in claim 9, wherein:

the first, second, and third input terminals of an odd-numbered stage receive a first clock signal, a second clock signal, and a third clock signal, respectively, and the first, second, and third input terminals of an even-numbered stage receive the second clock signal, the first clock signal, and a fourth clock signal, respectively.

14. The device as claimed in claim 13, wherein:

the first and second clock signals have substantially a same period, and the voltages of low signals of the first and second clock signals do not overlap each other.

15. The device as claimed in claim 14, wherein:

the third and fourth clock signals have substantially a same period, and the voltages of high signals of the third and fourth clock signals do not overlap each other.

16. The device as claimed in claim 15, wherein:

the high signal of the third clock signal overlaps the low signal of the second clock signal during at least one period, and the high signal of the fourth clock signal overlaps the low signal of the first clock signal during at least one period.

17. The device as claimed in claim 9, wherein the second supply circuit includes:

a first capacitor coupled between the fourth node and first input terminal; and a second capacitor coupled between the third node and second output terminal.

18. The device as claimed in claim 9, wherein the first supply circuit includes:

an output circuit to supply a first power source set to a gate-off voltage or the voltage of the second input terminal to the first output terminal, corresponding to voltages applied to a first node and a second node;

a first driver to control the voltage of the second node; and a second driver to control the voltage of the first node.

19. The device as claimed in claim 18, wherein the first driver includes:

a fifth transistor coupled between the fourth input terminal and the second node, the fifth transistor having a gate electrode coupled to the first input terminal; and sixth and seventh transistors coupled in series between the second node and first power source, wherein a gate electrode of the sixth transistor is coupled to the second input terminal, and a gate electrode of the seventh transistor is coupled to the first node, wherein the output unit includes:

an eighth transistor coupled between the first power source and the first output terminal, the eighth transistor having a gate electrode coupled to the first node;

a ninth transistor coupled between the first output terminal and second input terminal, the ninth transistor having a gate electrode coupled to the second node;

a third capacitor coupled between the second node and the first output terminal; and a fourth capacitor coupled between the first node and first power source.

20. The device as claimed in claim 19, wherein the second driver includes:

a tenth transistor coupled between the first node and the first input terminal, the tenth transistor having a gate electrode coupled to the second node; and a eleventh transistor coupled between the first node and second power source, the eleventh transistor having a gate electrode coupled to the first input terminal.

* * * * *